United States Patent [19]

Landa et al.

[11] Patent Number: 5,047,307

[45] Date of Patent: Sep. 10, 1991

[54] TONER FOR USE IN COMPOSITIONS FOR DEVELOPING LATENT ELECTROSTATIC IMAGES, METHOD OF MAKING THE SAME, AND LIQUID COMPOSITION USING THE IMPROVED TONER

[75] Inventors: Benzion Landa, Edmonton; Peretz Ben-Auraham; Joseph Hall, both of Rehovot, Israel; George A. Gibson, Endwell, N.Y.

[73] Assignee: Savin Corporation, Stamford, Conn.

[21] Appl. No.: 394,141

[22] Filed: Aug. 16, 1989

Related U.S. Application Data

[60] Continuation of Ser. No. 287,840, Dec. 21, 1988, abandoned, which is a division of Ser. No. 157,122, Feb. 10, 1988, Pat. No. 4,794,651, which is a continuation of Ser. No. 45,168, Apr. 24, 1987, abandoned, which is a continuation of Ser. No. 679,906, Dec. 10, 1984, abandoned, which is a continuation-in-part of Ser. No. 242,242, Sep. 9, 1988, abandoned.

[51] Int. Cl.[5] ..... G03G 9/13

[52] U.S. Cl. ..... 430/137

[58] Field of Search ..... 430/109, 110, 137

[56] References Cited

U.S. PATENT DOCUMENTS 4,631,244 12/1986 Mitchell .

4,707,429 11/1987 Trout ..... 430/115

FOREIGN PATENT DOCUMENTS 54-99636 3/1979 Japan ..... 430/137

59-159176 9/1989 Japan ..... 430/137

*Primary Examiner*—Roland Martin

*Attorney, Agent, or Firm*—Kenyon & Kenyon

[57] ABSTRACT

A liquid composition for developing latent electrostatic images comprising toner particles associated with the pigment dispersed in a nonpolar liquid. The salient feature of the invention is that the toner particles are formed with a plurality of fibers or tendrils from a thermoplastic polymer and carry a charge of a polarity opposite to the polarity of the latent electrostatic image. The polymer is insoluble or insolvatable in the dispersant liquid at room temperature. The toner particles are formed by plasticizing the polymer and pigment at elevated temperature and then either permitting a sponge to form and wet-grinding pieces of the sponge or diluting the plasticized polymer-pigment while cooling and constantly stirring to prevent the forming a sponge while cooling. When cool, the diluted composition will have a concentration of toner particles formed with a plurality of fibers.

18 Claims, 7 Drawing Sheets

TONER FOR USE IN COMPOSITIONS FOR DEVELOPING LATENT ELECTROSTATIC IMAGES, METHOD OF MAKING THE SAME, AND LIQUID COMPOSITION USING THE IMPROVED TONER

This application is a continuation of application Ser. No. 07/287,840, filed 12/21/88, now abandoned, which is a division, of application Ser. No. 157,122, filed 2/10/88, which is a continuation of application Ser. No. 45,168 filed Apr. 24, 1987, which in turn is a continuation of application Ser. No. 679,906 filed Dec. 10, 1984. This Application is also a continuation-in-part of application Ser. No. 242,242 filed Sept. 9, 1988.

BACKGROUND OF THE INVENTION

In the prior art, a latent electrostatic image is developed by dry toner particles or by toner particles dispersed in an insulating nonpolar liquid. The dry toner particles cannot be too fine, since they will become airborne and be disadvantageous to health should they escape into the circumambient atmosphere. Furthermore, the dry toner particles must be fixed by fusing at elevated temperatures, which requires a source of energy. The developing of latent electrostatic images by dry toners results in images which do not have the degree of resolution which is desirable. Liquid-carried toners, however, may be as fine as one can make them, since there is no danger of their becoming airborne. Accordingly, they may be employed to produce copy of increased resolution.

An electrostatic image may be produced by providing a photoconductive layer with a uniform electrostatic charge and thereafter discharging the electrostatic charge by exposing it to a modulated beam of radiant energy. It will be understood that other methods may be employed to form an electrostatic image, such, for example, as providing a carrier with a dielectric surface and transferring a preformed electrostatic charge to the surface. The charge may be formed from an array of styluses.

This invention will be described in respect of office copiers, though it is to be understood that it is applicable to other uses involving electrophotography.

In an office copier, after the latent electrostatic image has been formed, usually by projecting the desired information upon a charged photoconductor in the dark, the image is developed by a liquid comprising pigmented toner particles dispersed in a nonpolar, nontoxic liquid having a high-volume resistivity in excess of $10^9$ ohm centimeters, a low dielectric constant below 3.0, and a high vapor pressure. Suitable liquids, acting as dispersants, are the aliphatic isomerized hydrocarbons prepared by the Exxon Corporation and sold under such trademarks as ISOPAR-G, ISOPAR-H, ISOPAR-L and ISOPAR-M, each having different end points and vapor pressures.

After the image has been developed, it is transferred to a carrier sheet. During transfer, there occurs a degree of smudging, smearing, or squashing of the image. This reduces the resolution. Furthermore, the entire image does not transfer from the photoconductor to the carrier sheet. This leaves a residue of toner on the photoconductor which formed the image just transferred. The squash effect may be avoided by providing a gap between the developed image on the photoconductor and the carrier sheet to which the image is to be transferred. The density of the image and the resolution of the gap-transfer method are good, but are improved by the present invention.

FIELD OF THE INVENTION

Our invention relates to improved toner particles adapted to develop latent electrostatic images with increased density and high resolution when dispersed in a nonpolar liquid carrier, a method of making said particles, and a liquid composition for dispersing the toner particles. Our invention relates to a toner particle, preferably pigmented, which is formed with fibers, tendrils, tentacles, threadlets, fibrils, ligaments, hairs, extensions, elongations, bristles, peaks, or the like (hereinafter referred to as "fibers").

DESCRIPTION OF THE PRIOR ART

Blanchette et al 3,278,439 shows a dry developer mix in which irregularly shaped carrier particles, formed of ferromagnetic material, are adapted to interlock, intertwine, or link to form a brush-like structure adapted to carry electroscopic thermoplastic powder. This patent does not teach our invention.

Wright 3,419,411 seeks to provide a developing liquid having a pigment and a "lattice-forming material" (Column 2, line 12 et seq). The patentee describes his "lattice-forming substance" as "polymeric materials presenting a branched as distinguished from either a linear or closed chain molecule . . . which when in apparent solution in a liquid has a molecular structure in which one dimension is at least one order greater than its dimensions in two other dimensions at right angles to each other . . ." (Column 2, line 31 et seq; emphasis ours.) Wright hypothecates that molecules, linear in one direction only, are not capable of forming a lacy fiber (Column 2, line 48 et seq). It is believed that the theory set forth in irrelevant. The molecular dimensions deal in orders of magnitude of 10 Å. This contrasts with toner particles where the orders of magnitude dealt with are thousands of Å. In Example 1, Wright disperses a pigment in rubber modified polystyrene. It is understood that Solvesso 100 has a Kauri-butanol value of 93. It will dissolve the rubber compound. The solution is more like a coating than a "lattice". The image will be supported by the rubber coating. In Example 2, a varnish of polymerized linseed oil does the holding. Paraffin wax merely carries the pigment. The patentee designates the varnish as a "grinding aid". Similarly, in Example 3, a varnish, comprising hydrogenated rosin and polymerized linseed oil, are used. Again, the varnish is designated as a "grinding aid". In Example 4, paraffin wax and varnish are used in each of the four toners and again are designated as a "grinding aid". It is significant to note that, when paraffin wax is used, the high KB value of Solvesso is such that it will dissolve the paraffin wax. Accordingly, in connection with Example 4, the KB value of Solvesso has to be decreased by diluting it with Shellsol T, which has a KB value of only 26. It is pointed out that, when a low KB value is used, good resolution is not possible without a half tone screen (Column 6, line 1 et seq). Example 5 is the same as Example 4, except that the varnish eliminates the hydrogenated rosin and substitutes calcium resinate. In Example 6, the toners shown use Lucite in toluol and ethyl cellulose in Solvesso. Toluol has a KB value of over 100. Judging from the specification, it would appear that the pigment develops the image and a coating of varnish, wax, ethyl cellulose, rubber modified polystyrene, or Lucite is formed over the deposited pigment. This coating is formed as the resin or wax is deposited as the solvent evaporates. It is the coating deposited over the pigment which prevents the spreading of the pigment particles. The toner particles themselves do not have any fibers as contemplated in the instant invention.

Machida et al 3,668,127 discloses a toner particle having a first resinous coating for a pigment. This coating is insoluble in the dispersing agent. The particle, however, is coated with a second resinous coating which is swellable—that is, solvatable—in the dispersant. In the instant invention, the resin must be insoluble at ambient temperatures and solvatable only at elevated temperatures. The swellability of the resin indicates that solvation has occurred. In Machida, there is no disclosure of fibers extending from the toner particle, which fibers are adapted to intertwine, interdigitate, or mat so as to accomplish the objects of the instant invention.

Gilliams et al 3,909,433 relates to a toner particle formed by coating a pigment with a resin derived from rosin. The coated particle is then ground to a fine powder. This powder is then suspended in a nonpolar carrier liquid together with an alkylated polymer of a heterocyclic N-vinyl monomer to impart positive polarity to the resincoated toner particle. There is no teaching of fibers.

Lawson et al 3,949,116 seeks to avoid wetting the photoconductor bearing the latent electrostatic image, or the carrier sheet to which the developed image is to be transferred, with an excess of liquid. The patentees do this by forming a gel of a pigmented resin and a dispersant liquid, which gel has thixotropic properties. When it is desired to develop a latent image, the gel is fed under a roller, or the like, to convert the developer from a gelatinous state to a liquid state in the vicinity of the roller. Only the area under shear stress is converted into a liquid state. When the shear stress is dissipated, the developer reverts to the gelatinous state. No toner having fibers is taught.

Tsuneda 3,998,746 relates to a toner comprising colored particles coated with a rubber. The rubber coating is applied from a solution of the rubber which has been subjected to an elevated temperature in excess of 150° C. While no disclosure of a toner particle having fibers appears, it will be clear that any fibers, which are the salient feature of the instant invention, will be coated over with the rubber and thus defeat the objects of this invention.

Brechlin et al 4,157,974 is an improvement of Smith et al Patent 3,939,085, which discloses a liquid developer organosol for developing a latent electrostatic image to provide a tacky developed image. This image may be transferred to a carrier sheet merely by the tackiness of the image and without the use of an electrical field. The difficulty of this type of developer is that it agglomerates when not in use. Brechlin et al seek to provide protective colloids to prevent agglomeration of the pigmented polymer in the dispersing liquid. The patentees form pigmented polymers which are tacky. The images developed with these toners can be transferred by simple contact (Column 10, line 57, et seq). The tackiness can be increased by adding an aromatic hydrocarbon solvent, such as Solvesso 100 (Column 10, line 62 et seq). Furthermore, the toner particles are spherical in form (Column 7, line 18 et seq). There is no disclosure of a toner formed with fibers.

Landa et al 4,411,976 discloses a toning composition designed for use in developing a latent electrostatic image across a gap between the carrier sheet and the developed image. It is true that the composition can be used for developing an image by contact transfer of the developing liquid with the latent electrostatic image to be developed. However, squash—which is the salient object of this invention to eliminate—would occur. No toner particles having the essential fibers are taught by this reference. With contact development, instead of gap development, the developed image, when transferred to a paper carrier sheet, will exhibit bleed-through in many instances.

The Japanese patent publication of Application No. Sho 56/1981-93330, filed June 16, 1981, which was laid open on Dec. 18, 1982 as Laid Open Patent Publication No. Sho 57/1982-207259, discloses the formation of small projections on the surface of a spherical toner particle. These projections are formed of a resin incorporating an insoluble powder. The purpose of the projections is to enable the ready removal of a developed image from the surface on which it was developed, so that the blade which cleans the surface will have a longer life. The preferred material is a thermosetting resin. There is no disclosure whatever of any formation of fibers.

Japanese Patent Application 58-2851, published Jan. 8, 1983, in which Obata is the inventor, discloses the manufacture of a wet toner for making printing plates. In Obata, a partially saponified ethylene-vinyl acetate copolymer and carbon black are mixed with toluene and the polymer is dissolved by heating to 80° C. The heated solution is then cooled while stirring in n-hexane. Particles are formed which are precipitated to the bottom of the container. A latent electrostatic image was developed from the toner as described. One example given is ethylene-vinyl acetate polymer dipped in liquid nitrogen and then pulverized with a hammer. Powder thus obtained was dispersed in Isopar H. There is no disclosure of plasticizing the polymer and then either forming a sponge or preventing the formation of the sponge in order to produce fibers. No disclosure appears of forming fibers anywhere in the disclosure. Indeed, the formation of a powder with a hammer negates the presence of any particle having fibers.

SUMMARY OF THE INVENTION

In general, our invention contemplates the production of a toner particle possessing a morphology of a plurality of fibers as the term is defined above. These fibers are formed from a thermoplastic polymer and are such that they may interdigitate, intertwine, or interlink physically in an image developed with a developing liquid through which has been dispersed the toner particles of the instant invention. The result is an image having superior sharpness, line acuity—that is, edge acuity—and a high degree of resolution. The salient feature of the developed image is that it has good compressive strength, so that it may be transferred from the surface on which it is developed to a carrier sheet without squash. Because of the intertwining of the toner particles, we may build a thicker image and still obtain sharpness. The thickness can be controlled by varying the charge potential on the photoconductor, by varying the development time, by varying the toner-particle concentration, by varying the conductivity of the toner particles, by varying the charge characteristics of the toner particles, by varying the particle size, or by varying the surface chemistry of the particles. Any or a combination of these methods may be used.

In addition to being thermoplastic and being able to form fibers as above defined, the polymer must have the following characteristics:

1. It must be able to disperse a pigment (if a pigment is desired).
2. It must be insoluble in the dispersant liquid at temperatures below 40° C., so that it will not dissolve or solvate in storage.
3. It must be able to solvate at temperatures above 50° C.
4. It must be able to be ground to form particles between 0.1 micron and 5 microns in diameter.
5. It must be able to form a particle of less than 10 microns.
6. It must be able to fuse at temperatures in excess of 70° C.
7. For photocopy applications a sponge formed from it (as hereinafter described) must have a hardness, as measured by a Precision Universal Penetrometer, greater than 120, though in many instances a polymer of this hardness would be too soft.

By solvation, the polymers forming the toner particles will become swollen or gelatinous. This indicates the formation of complexes by the combination of the molecules of the polymer with the molecules of the dispersant liquid.

We have found three methods of forming toner particles having the desired fibrous morphology. In essence, we disperse or dissolve a pigment in a plasticized polymer at temperatures between 65° C. and 100° C. The plasticized material when cooled has the form of a sponge. The sponge is then broken into smaller pieces and ground. This method will be described more fully hereinafter.

Another method of forming our toner particles is to dissolve one or more polymers in a nonpolar dispersant, together with particles of a pigment such as carbon black or the like. The solution is allowed to cool slowly while stirring, which is an essential step in this method of forming our fiber-bearing toner particles. As the solution cools, precipitation occurs, and the precipitated particles will be found to have fibers extending therefrom.

A third method is to heat a polymer above its melting point and disperse a pigment through it. In this method, fibers are formed by pulling the pigmented thermoplastic polymer apart without first forming a sponge.

The fibrous toner particles, formed by any of the foregoing methods, are dispersed in a nonpolar carrier liquid, together with a charge director known to the art, to form a developing composition.

OBJECTS OF THE INVENTION

One object of our invention is to provide a denser developed electrostatic image than the prior art has been able to achieve.

Another object of our invention is to provide a developing composition, including a toner, which will enable substantially complete transfer of the developed electrostatic image.

Still another object of our invention is to enable the transfer of a developed electrostatic image to a carrier sheet with no squash.

A further object of our invention is to provide a developed electrostatic image capable of being transferred with high resolution.

A still further object of our invention is to provide a developed electrostatic image capable of being transferred with exceptional contrast.

An additional object of our invention is to provide a developed electrostatic image which may be transferred to a carrier sheet with no bleed-through.

Still another object of our invention is to provide developed electrostatic images which may be transferred to carrier media of various materials having various degrees of surface roughness.

A further object of our invention is to provide a novel method of making an improved toner particle.

A still further object of our invention is to provide a liquid composition, using our improved toner particles, for developing liquid electrostatic images.

Other and further objects of our invention will appear from the following description.

DESCRIPTION OF THE PREFERRED EMBODIMENT

Figure 1:
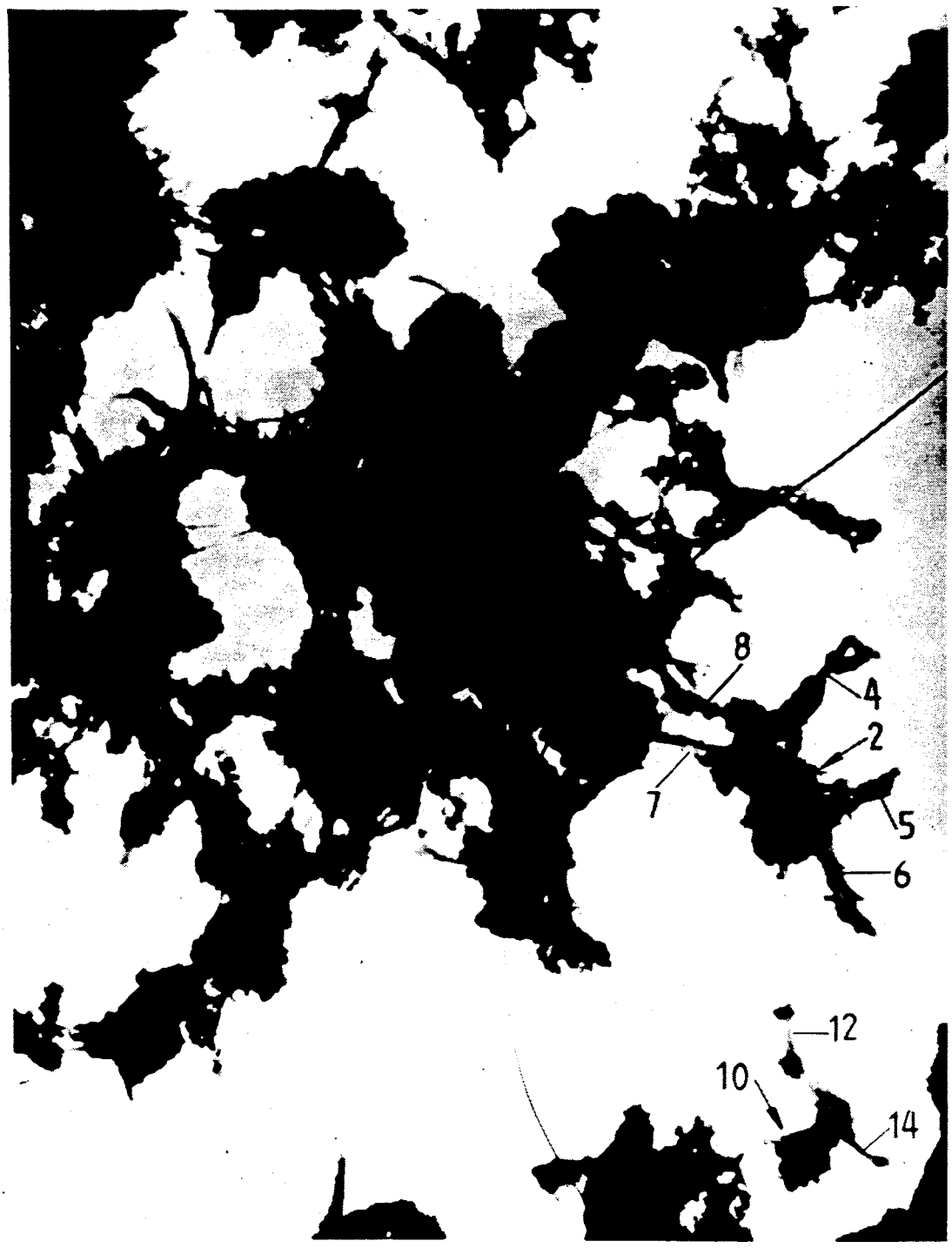
FIG. 1 is a photomicrograph taken with a transmission electron beam microscope at a magnification of 13,000 times, showing a dispersion containing the toner particles of our invention.

The salient feature of our invention is a toner particle formed with a plurality of fibers—that is to say, one with such morphology. The novel toner particle enables us to form a developing composition for developing latent electrostatic images by dispersing the toner particles in small amounts in a nonpolar liquid such as an ISOPAR. The weight of the toner particle may be as low as 0.2 percent by weight of the weight of the dispersant liquid. The toner particle is pigmented and formed of a polymeric resin. A charge director is added to the composition in small amounts, which may be as low as one-tenth percent by weight of the weight of the toner particles in the developing composition. The charge director may be selected to impart either a positive or a negative charge to the toner particles, depending on the charge of the latent image. Those in the art will understand that the charge on the toner particles is generally opposite in polarity to that carried by the latent electrostatic image.

The nonpolar dispersant liquids are, preferably, branched-chain aliphatic hydrocarbons —more particularly, ISOPAR-G, ISOPAR-H, ISOPAR-K, ISOPAR-L, and ISOPAR-M. These ISOPARs are narrow cuts of isoparaffinic hydrocarbon fractions with extremely high levels of purity. For example, the boiling range of ISOPAR-G is between 156° C. and 176° C. ISOPAR-L has a mid-boiling point of approximately 194° C. ISOPAR-M has a flash point of 77° C. and an auto-ignition temperature of 338° C. Stringent manufacturing specifications, such as sulphur, acids, carboxyl, and chlorides are limited to a few parts per million. They are substantially odorless, possessing only a very mild paraffinic odor. They have excellent odor stability and are all manufactured by the Exxon Corporation. Light mineral oils, such as MARCOL 52 or MARCOL 62, manufactured by the Humble Oil and Refining Company, may be used. These are higher boiling aliphatic hydrocarbon liquids.

All of the dispersant liquids have an electrical volume resistivity in excess of $10^9$ ohm centimeters and a dielectric constant below 3.0. The vapor pressures at 25° C. are less than 10 Torr. A desirable ISOPAR is ISOPAR-G, which has a flash point, determined by the tag closed cup method, of 40° C. ISOPAR-L has a flash point of 61° C., determined by the same method; while ISOPAR-M has a flash point, determined by the Pensky-Martens method, of 77° C. While we have described the preferred dispersants, the essential characteristics are the volume resistivity and the dielectric constant. In addition, a feature of the dispersants is a low Kauri-butanol value, in the vicinity of 27 or 28, determined by ASTM D 1133.

The polymers used must be thermoplastic, and the preferred polymers are known as ELVAX II (trademark), manufactured by E. I. du Pont de Nemours & Company. The original ELVAX resins (EVA) were the ethyl vinyl acetate copolymers. The new family of ELVAX resins, designated ELVAX II, are ethylene copolymers combining carboxylic acid functionality, high molecular weight, and thermal stability. The acid numbers range as follows:

| Resin | Acid Number | Melt Index at 190° C. |
|---|---|---|
| 5550 | 54 | 10 |
| 5610 | 60 | 500 |
| 5640 | 60 | 35 |
| 5650T * | 60 | 11 |
| 5720 | 66 | 100 |
| 5950 | 90 | 25 |

* "T" denotes Terpolymer

The greater thermal stability and higher strength properties of ELVAX II resins are due to two factors. First, the presence of an alkyl group on the same carbon atom on the polymer chain to which is attached a carboxylic acid group increases the chain stiffness and the energy required for rotation of the polymer chain. Second, hydrogen bonding, brought about by the intermolecular and intramolecular dimerization, establishes a resonance stabilized configuration.

The preferred ethylene copolymer resins are the ELVAX II 5720 and 5610. Other polymers which we have tested are isotactic polypropylene (crystalline). Other polymers which are usable are the original ELVAX copolymers and polybutyl terethalate. Other polymers tested are the ethylene ethyl acrylate series made by Union Carbide and sold under the trademark BAKELITE. They are the DPD 6169, DPDA 6182 Natural, and DTDA 9169 Natural. Still other useful polymers made by Union Carbide are the DQDA 6479 Natural 7 and DQDA 6832 Natural 7. These are ethylene vinyl acetate resins.

Another class of polymers useful in practicing our invention are those manufactured by E. I. du Pont de Nemours & Company and sold under the trademark ELVACITE. These are methacrylate resins, such as polybutyl methacrylate (Grade 2044), polyethyl methacrylate (Grade 2028), and polymethyl methacrylate (Grade 2041). If desired, a minor amount of carnauba wax may be added to the composition. However, this tends to produce bleed-through and an oil fringe on the copy and is not preferred. Furthermore, if a hard polymer such as 5650T is used, a minor amount of hydroxyethyl cellulose may be added. This is not preferred.

The polymers are normally pigmented so as to render the latent image visible, though this need not be done in some applications. The pigment may be present in the amount of 10 percent to 35 percent by weight in respect of the weight of the polymer, if the pigment be Cabot Mogul L (black pigment). If the pigment is a dye, it may be present in an amount of between 3 percent and 25 percent by weight in respect of the weight of the polymer. If no dye is used —as, for example, in making a toner for developing a latent image for a printing plate—an amount of silica such as Cabosil may be added to make the grinding easier. Examples of pigments are Monastral Blue G (C.I. Pigment Blue 15 C.I. No. 74160), Toluidine Red Y (C.I. Pigment Red 3), Quindo Magenta (Pigment Red 122), Indo Brilliant Scarlet Toner (Pigment Red 123, C.I. No. 71145), Toluidine Red B (C.I. Pigment Red 3), Watchung Red B (C.I. Pigment Red 48), Permanent Rubine F6B13-1731 (Pigment Red 184), Hansa Yellow (Pigment Yellow 98), Dalamar Yellow (Pigment Yellow 74, C.I. No. 11741), Toluidine Yellow G (C.I. Pigment Yellow 1), Monastral Blue B (C.I. Pigment Blue 15), Monastral Green B (C.I. Pigment Green 7), Pigment Scarlet (C.I. Pigment Red 60), Auric Brown (C.I. Pigment Brown 6), Monastral Green G (Pigment Green 7), Carbon Black, and Stirling NS N 774 (Pigment Black 7, C.I. No. 77266).

If desired, a finely ground ferromagnetic material may be used as a pigment. While about 40 percent to about 80 percent by weight of Mapico Black is preferred, with about 65 percent Mapico Black being optimum, other suitable materials such as metals including iron, cobalt, nickel, various magnetic oxides including $Fe_2O_3$, $Fe_3O_4$, and other magnetic oxides; certain ferrites such as zinc, cadmium, barium, manganese; chromium dioxide; various of the permalloys and other alloys such as cobalt-phosphorus, cobalt-nickel, and the like; or mixtures of any of these may be used.

A preferable first step, in the method of making our new toner particle, includes the forming of a gel or an open-cell sponge having a hardness of at least 120 as measured by a Precision Universal Penetrometer (with timer) No. 73515, manufactured by GCA Precision Scientific, of Chicago, Ill., and used according to ASTM D5-83 procedure. A 1.02 mm diameter weighted needle (total weight 50 grams) penetrates the samples for 5 seconds.

In our method, the plasticizer may be the same as the carrier liquid, or a heavier liquid such as ISOPAR-M, or mineral oil USP (viscosity 36 centistokes). This is preferred for the ELVAX II resins. With polyvinyl chloride as the polymer, dioctyl phthalate is the plasticizer of choice. With Nylon (polyamide), benzyl alcohol may be used as the plasticizer. The useful range of plasticization ratios ranges from 1:1 to 1:5 by weight.

The addition of waxy substances such as carnauba wax reduces the grinding time. In addition to carnauba wax, other waxy substances such as cocoa butter, Japan wax, beeswax, microcrystalline wax, and low molecular weight polyolfins such as polyethylene and ethylenevinyl acetate copolymer may be added. Care should be taken not to employ waxes which may act as charge directions.

In its simplest aspect, our method begins, as pointed out above, by plasticizing a quantity of a desired polymer with a pigment, together with a plasticizer, and mixing until homogeneity is achieved. After thorough mixing, the material is removed from the mill and allowed to cool. It will have the form of a sponge. As pointed out above, the sponge should have a hardness of at least 120. A hardness of between 25 and 45 is preferable. The temperature for mixing may range from between 65° and 100° C. —preferably 90° C. Mixing times may range between 10 minutes and 3 hours. A preferable time is about 90 minutes. Any suitable mixing or blending device may be employed—as, for example, the Ross double planetary mixer (manufactured by Charles Ross and Son, of Hauppauge, N.Y.).

After the mixture has been cooled, it is sliced into strips and ground in a General Slicing meat grinder (manufactured by General Slicing/Red Goat Dispensers, of Murfreesboro, Tenn.). The ground material is then charged to an attritor, disk mill, sand mill, impeller attrition mill, vibro-energy mill, or the like. The object of the grinding is to pull the larger particles apart and, in so doing, to form fibers on the toner particles. This is in contradistinction to the toners of the prior art, in which the purpose of grinding is merely to reduce the particle size.

An important feature of this method is to wet-grind the composition. The liquid used during the grinding operation may be ISOPAR-H, which is present in the amount of 70 percent to 90 percent by weight in respect of the polymer. During the grinding, the particle size is determined by centrifugal analysis, using a Horiba Centrifugal Particle Size Analyzer, Model CAPA 500, manufactured by Horiba Instruments, Inc., of Irvine, Calif. Thermal transitions are measured, using a Du Pont 1090 Thermal Analyzer System with dual cell, DSC #912, using non-hermetic pans, a scan rate of 20° C./min, a temperature range of −40° C. −200° C. and multiple scans.

Toner-performance evaluation is conducted as follows: A 5-percent solution of basic barium petronate (Witco Chemical, Sonneborne Division, New York, N.Y.) in ISOPAR-H is prepared. Toner concentrate is diluted to 1.5 percent solids with ISOPAR-H, and 2 Kg of this dispersion are placed in the development tank of a Savin 870 office copier (Savin Corporation, Stamford, Conn.). The basic barium petronate, which functions as a charge-directing agent, is added in increments, allowing 24 hours for equilibration after each addition. At each equilibrated level of charge director, the conductivity of the dispersion is measured (using a device constructed by Savin Corporation, Johnson City, N.Y.) and toner performance is evaluated. Solid area density, the influence of fusion on density, line resolution, and efficiency of image transfer from photoconductor to substrate, and general image quality are evaluated on several substrates: Plainwell offset enamel, Savin 2200 and 2100 and Gilbert Bond (50-percent rag) papers, and Savin transparency material (smooth and matte).

After grinding has been completed, the composition may be filtered or centrifuged. The filtrate is then dispersed in ISOPAR-H and mixed with a charge director to form a concentrate. This concentrate has a solids content of 10 percent to 30 percent by weight. The amount of charge director is dependent on its characteristics and the requirements of the use to which the toner is to be put.

In one process in which the original polymer has not been plasticized, it is not desirable to use a polymer which has a melting point in excess of 160° C. The mixing step and the wet-grinding step take much longer with an unplasticized polymer. We have found that it is advantageous to add a plasticizer, in the first step, in the ratio of in the order of three parts of plasticizer by weight to one part of resin by weight.

Examples of the method by which we obtain toner particles formed with fibers are given by way of illustration, and not by way of limitation.

EXAMPLE 1

In a Ross planetary mixer, we combined 500 grams of ELVAX II polymer 5720 and 500 grams of ISOPAR-L at 78° C. After mixing for thirty minutes, 125 grams of carbon black (Mogul L) were added, and mixing was continued for an hour at 82° C. At this time, the addition of 1000 grams of ISOPAR-L was started and continued for one hour. The material was discharged at 90° C. through a 0.5 mm orifice into ice water. This material had the form of a sponge. The sponge was passed through a meat grinder, which shredded the sponge into pieces of a size adapted to pass through a 50 mesh screen. The pieces were then passed to the wet-grinding step. We ground 28.8 grams of the sponge pieces with 171.2 grams of ISOPAR-H for a period of 75.5 hours in a Type 0-1 attritor (Union Process Company) equipped with tap-water cooling and 3/16-inch steel balls. The grinding pulled the elastomeric polymer particles apart, forming fibers present in concentration. We diluted the concentrate to 2 percent solids and added a charge director to form a developing liquid. The charge director was added to a number of samples in amounts varying from 1 to 100 milligrams per gram of toner solids. A developing liquid was then diluted with ISOPAR-G, so that the toner particles were present in the amount of 0.2 percent by weight in respect of the dispersant ISOPAR, and copies were made on a Savin 870 copier. After transfer of the developed electrostatic image to a carrier sheet, the copier was stopped and strips of adhesive tape were placed on the photoconductor to remove the residue of the toned image from the photoconductor. We found that the transfer was over 90 percent.

EXAMPLE 2

In a Ross planetary mixer were combined 750 grams of ELVAX II 5610 and 353 grams of ISOPAR-G at 85° C. After mixing for thirty minutes, a ground mixture of 132 grams of Monastral BT-383-D blue pigment and 397 grams of ISOPAR-H were added and mixed for an hour. At this time, 2250 grams of ISOPAR-G were added over one hour, and then the mixture was stirred for thirty minutes. A sponge thus formed was then cooled to 80° C. and discharged with a pump into aluminum pans. After the sponge was cooled, it was abraded to small particle size as in Example 1. A Model S-0 attritor, equipped with tap-water cooling and 3/16-inch steel balls, was charged with 1101 grams of the sponge particles and 899 grams of ISOPAR-H. The mixture was ground for 65 hours. The ground material was then employed as in Example 1, to form a development liquid, and poor transfer was noted.

EXAMPLE 3

The procedure of Example 1 was followed with a blend of 25 parts by weight of ELVAX II 5650T resin, 50 parts by weight of UNIREZ (a Union Camp polyamide resin), and 25 parts by weight of carbon black in respect of the solids content of the mixture. During the grinding step, it was found that no suitable fibers were formed. This formulation is not preferred, since many fibers are fractured owing to their brittleness.

EXAMPLE 4

When the procedure of Example 1 was followed, using poly (4-methyl pentene), it was found that the polymer would not easily disperse carbon black.

EXAMPLE 5

We mixed 500 grams of Union Carbide's BAKELITE DPD 6169 with 500 grams of ISOPAR-L in a Ross planetary mixer at 100° C. for an hour. We then added 166.6 grams of carbon black (Mogul L) to the mixture and mixed it for another hour, at which time it was a homogenous mixture. This was then discharged into cake pans and allowed to cool. The procedure of Example 1 was followed and excellent results were obtained. Substantially complete transfer was made to a carrier sheet comprised of clay-coated paper stock (printer's stock). This has a smooth, non-absorbent surface. No squash or smudging was observed, and there was remarkably exceptional edge definition and acuity. This test has proven to be particularly difficult with liquidcarried toners of the prior art.

EXAMPLE 6

We charged 37-½ parts by weight of carnauba wax, 37-½ parts by weight of polypropylene, and 25 parts by weight of carbon black into a Ross planetary mixer and blended the mixture until it was homogeneous. The mixture was then removed, allowed to cool, and treated as in Example 1. It remained in the attritor for 36 hours and was then tested. It was found that the transfer of the developed image, instead of being 90 percent or more, was only in the vicinity of 60 percent. However, a satisfactory image was achieved.

EXAMPLE 7

In a Ross planetary mixer were combined one kilogram of ELVAX II 5720 and one kilogram of ISOPAR-L at 85° C. and mixed for thirty minutes. At this time, 176 grams of Cabosil (silica) were added and the material was mixed for one hour. The material was then discharged into aluminum pans and cooled to room temperature. After being abraded into particles, as in Example 1, the sponge was subjected to grinding in an attritor for 25 hours. The presence of silica makes the grinding easier. No black or colored pigment was present in the toner. This toner may be employed as an etch-resist for making printed circuit boards or for making printing plates and the like.

EXAMPLE 8

In a Ross planetary jacketed mixer, we blended 500 grams of 5720 ELVAX II polymer with 250 grams of ISOPAR-L at a temperature of 90° C. to plasticize the polymer. We then added 166.6 grams of carbon black (Mogul L) and mixed the mixture until the pigment was dispersed. This occurred in about one hour, when it was a viscous mass. We continued stirring while adding 1750 additional grams of ISOPAR-L over a period of two hours. When the material is homogeneous we cease heating and continue stirring. The mixture will have reached ambient temperature of about 25° C. It is a critical feature of this method of forming toner particles having a plurality of fibers to continue stirring while cooling the mixture. This prevents the formation of a sponge and permits the precipitation of pigmented toner particles out of the dispersion formed by the addition of the added ISOPAR-L and encapsulates or otherwise associates the pigment with the polymer. The mixing elements of the mixer are operated to revolve at about 20 revolutions per minute. When the newly formed pigmented toner particles have been thus made, they will be present in about 30 percent by weight with respect to the weight of the liquid. It is to be understood that other nonpolar liquids having elevated vapor pressures, such as other ISOPARs or light hydrocarbon oils, may be used as liquids. The developing liquid with a high concentration of toner particles may be packaged and diluted in a copy machine, as is known to the art. If desired, the mixing vessel may be water-cooled with tap water and the formation of the fiber-bearing toner particles accelerated. We may employ a mixture of a number of different polymers simultaneously. A suitable charge director may be added during the stirring period or at any convenient time. The liquid developer composition is then drawn from the vessel. The concentration of the toner particles was reduced to 2 percent by weight with ISOPAR and a toner thus made employed to develop a latent electrostatic image in a Savin office copier. The developed image was transferred to a carrier sheet and was found to have the improved characteristics of high density and superior resolution. Furthermore, there was excellent transfer from the surface of the photoconductor to a carrier sheet with reduced residue on the photoconductor surface.

EXAMPLE 9

Into a Ross planetary mixer we deposited 166 grams of Mogul L, 500 grams of ELVAX II Grade 5720 and 500 grams of ISOPAR-L, the mixture being heated to a temperature of 90° C. The mixture was vigorously stirred and the temperature was maintained at 90° C.±10° C. until the pigment was thoroughly dispersed. 1500 grams of ISOPAR-L were then slowly added. The homogeneous mixture was then discharged to a shallow metal pan and cooled to room temperature to give a gelatinous material having a penetrometer reading of 35±0.5. This sponge-like material was then sliced into small strips and ground up, using a General Slicing meat grinder (manufactured by General Slicing/Red Goat Dispensers, Murfreesboro, Tenn.). ISOPAR-H and 665 grams of the ground sponge-like material were charged to a Type 1-S Attritor stirred ball mill (Union Process Company, Akron, Ohio) containing 3/16-inch stainless steel balls for the final particle size reduction. The mill was run at slow speed during charging. After completion of the addition, the milling speed was increased and milling was continued for about 30 hours to give a particle size distribution that showed that less than 10 percent of the particles were greater than 3 microns (by area) and average particle size (by area) was 1.0±0.5 μm. The mill was discharged and the dispersion was diluted with an additional amount of ISOPAR-H to give a 2 percent solids liquid electrographic developing composition.

Performance was evaluated at two levels of charge director—37 mg/g toner solids and 47 mg/g toner solids—using the procedure described earlier. The 47 mg/g level is close to optimum for image quality. Overall image quality is good, with little squashing and good edge acuity, relative to images obtained with commercial Savin 870 toner. The efficiency of image transfer is also improved relative to that observed with the commercial toner. Solid density and line resolution are also improved.

On Plainwell offset enamel paper, the improved developing liquid made with toner particles of the instant invention showed a remarkably high density of 3.0 with a resolution of 9 line pairs/mm. On Savin 2100 paper, the resolution remained at 9, but the density as measured by a Macbeth reflectance densitometer dropped to 1.6. On transparent matte material, the resolution dropped to 8 and the density dropped to 1.6. On transparent smooth material, the density increased to 1.9 and the resolution was 9. On Gilbert bond, the density dropped to 1 and the resolution was 6.3. This compares with the Savin prior-art toner, in which the density was 1.6 for the Plainwell offset enamel paper, with a resolution of 8; a density of 1.4 for the 2100 paper, with a resolution of 8; with a transparent smooth material, a density of 1.2, with a resolution of 5; with a transparent matte material, a density of 1.2, with a resolution of 10; and a Gilbert bond density of 1, with a resolution of 5. The transfer efficiency of an image developed with our new toner is about 80% as compared with 60% for the prior art.

EXAMPLE 10

Into a Ross double planetary mixer we charged 500 grams of ISOPAR-L, heated to a temperature of 110° C., together with 214.2 grams of Mogul 1 and 500 grams of ELVAX II resin, Grade 5720. The mixture was thoroughly stirred until the pigment was dispersed. 2000 grams of ISOPAR-L were then slowly added until the mixture became homogeneous. It was then discharged, cooled, sliced, and ground as in Example 9. The sponge thus formed had a penetrometer reading of 35.0±0.5. Toner quality was determined by the procedure described in Example 9. The final particle size reduction was achieved as in Example 9. Excellent resolution, transfer and optical density were achieved.

EXAMPLE 11

Example 9 was repeated (500 grams Elvax® II Grade 5720, 500 grams Isopar® L), except that 88.2 grams of Mogul L were used. The mixture was stirred at 70° C. and this temperature was maintained until the pigment was thoroughly dispersed. No additional plasticizer was added. 330 grams of ground sponge material and 1800 grams of Isopar® H were used for the grinding step. The pigmented resin sponge was found to have a penetrometer reading of 1.0±0.5. Toner performance was equal to Example 1.

EXAMPLE 12

We prepared a magnetic-electrostatic toner composition using Day Ferrix 8600 ($Fe_3O_4$, 0.2 microns) as pigment. Elvax II resin 5720 (25 grams) and Isopar® L (125 grams), Day Ferrox (25 grams) were charged in an 01 air attritor at 90° C. until a homogenous mixture was obtained. The attritor was cooled to room temperature with continuous milling, and Isopar® H (150 grams) was added. Milling was continued at room temperature until a particle size in the vicinity of 2 microns was achieved. The dispersion was then diluted with Isopar® H and charge-directed. This toner was used in the following manner.

A magnetic printing plate was made by flash imaging a magnetically structured $CrO_2$ coated film (aluminized 4 mil Mylar® base coated with 200 micro-inch layer of $CrO_2$. The $CrO_2$ was magnetically structured with 1000 lines/inch. Flash imaging was done using a Cirtrak imager operating at an energy setting of 87. The magnetic printing plate was then mounted on the print drum of a Savin 770 copier in place of the selenium layer normally used. The machine was charged with the magnetic-electrostatic toner described above. Images were obtained on paper by running the machine in the usual fashion except the charging electrode was turned off and the development electrode and the $CrO_2$ film were grounded.

Metal surfaces will also be imaged by this method.

EXAMPLE 13

We followed the same procedure as in Example 9, using 450 grams of ELVAX II 5720 resin in a Baker-Perkins mixer in which the jacket temperature was raised to 125° C. with steam, and mixing was started and continued at this temperature until the resin was melted. This took place at 103° C. Mixing was continued while 125.5 grams of Quindo Magenta and 23.9 grams of Indo Brilliant Scarlet toner were added. The melt dispersion was continued for 23 hours; then 450 grams of ISOPAR-L were added and blending was continued until a homogeneous mixture was obtained. This mixture was then discharged into a pan and cooled to give 856.1 grams of a first pigmented polymer sponge. This sponge was cryogenically cooled with liquid nitrogen and then broken up with a hammer. The lumps thus formed were placed in a vacuum oven at 50° C. to remove water which had condensed on the chilled fragments.

Another pigmented gel was prepared by this procedure with ELVAX II 5610, except that the temperature during the preparation of the resin melt was maintained at 122° C. and the melt dispersion was continued for 19 hours, after which the temperature of the jacket was lowered to 100° C. prior to the addition of ISOPAR-L. Stirring was continued for 2 hours thereafter to give 934.3 grams of a second pigmented polymer sponge.

A mixture of 71 grams of the first pigmented polymer sponge and 29 grams of the second pigmented polymer sponge, together with 129 grams of ISOPAR-L, were placed in a plastic beaker equipped with a Jiffy mixer and a high torque stirrer. The beaker was placed in a 90° C. water bath and stirred for 2 hours. The hot mixture was then poured into a jar to give 197.5 grams of a magenta polymer sponge having a penetrometer reading of 34. This sponge was then pulverized. 120 grams of ISOPAR-H were placed in a Type 01 attritor (Union Process Company) equipped with 3/16-inch stainless steel balls. The air motor was started at a slow speed while 128 grams of the pulverized magenta polymer sponge were added. After the addition of the pulverized sponge, the air supply to the motor was increased 40 pounds per square inch and the jacket of the attritor was cooled with cold tap water. The attritor was run for 29-½ hours to form a toner slurry. This was run through a coarse paint filter, using an additional amount of ISOPAR-H to give a 2 percent solids magenta content in the toner. A particle size analysis shows the average particle size (by area) to be 1.21 microns. The resulting toner produced unsatisfactory images.

EXAMPLE 14

We heated 75 grams of ELVAX II 5610 resin to 100° C. and melted it onto the rollers of a rubber mill. We added 15 grams of mineral oil (MARCOL 52) and blended in 15 grams of carbon black. The mixture became homogeneous in about an hour and the melt was then removed from the rollers. This mixture was cooled by liquid nitrogen and transferred to a Brinkman ZM1 centrifugal grinding mill. We then placed 29.2 grams of the ground material with 160 grams of ISOPAR-H in a research attritor (Union Process Company Model 01) equipped with tap water cooling and ¼-inch steel balls. The mixture was ground for 24 hours and was found to have the morphology of our invention—namely, a plurality of fibers. It should be noted that, where a dry powder is formed from the grinding, we routinely pass the ground material through a 140 mesh screen. After grinding, we diluted the dry powder, to form a liquid composition, and added a charge director. We made a plurality of samples with various amounts of charge director between 1 and 100 milligrams per gram of toner solids. If sufficient plasticizer is added to the polymer in the first step to form a sponge, it is sufficiently soft so that it need not be cryogenically ground.

It is to be understood that we may mix a number of polymers with the ethylene vinyl acetate copolymers, such as polypropylene, polyamides, and the like. We have noted that the use of additives, such as polyethylene, carnauba wax, or the like, reduces the grinding time and that it also reduces the number of fibers attached to the polymer nuclei. We have made a large number of toner particles having fibers from various thermoplastic resins. Liquid toner compositions having our improved toner particles dispersed therethrough show various degrees of improvement in respect of increased density and increased resolution. These liquid compositions have the ability to develop electrostatic images, and the developed images have an increased ability to transfer from the photoconductor or dielectric surface to a carrier sheet. The improved results are also exhibited on carrier sheets having surfaces of various degrees of roughness.

EXAMPLE 15

Following the procedure of Example 1, we used 37.5 percent by weight of ELVAX II Grade 5610 resin, 37.5 percent by weight of ELVAX II Grade 5640 resin, and 25 percent by weight of carbon black (Mogul L). A developing liquid having a 2 percent solids content of the concentrate thus formed, when used to develop latent electrostatic images, produced dense images and excellent line resolution. Furthermore, there was excellent efficiency of the image-transfer from the photoconductor to the carrier sheet when used in a Savin 870 copying machine.

EXAMPLE 16

This example is similar to Example 15, except that 37.5 percent by weight of ELVAX II Grade 5720 resin was employed instead of ELVAX II Grade 5640 resin. The images and transfer efficiency were similar or superior to Example 15.

EXAMPLE 17

The procedure of Example 1 was followed, using 97 percent by weight of ELVAX II Grade 5720 polymer and 3 percent of Monastral Blue G pigment (manufactured by E. I. Du Pont De Nemours & Company). Unsatisfactory images were produced.

EXAMPLE 18

Example 23 below was repeated using 2.7 grams of BT-383D CPC blue pigment and 8.0 grams fumed silica (Cab-O-Sil EH-5) in place of Mogul L (carbon black). Resolution was 9, Transfer Efficiency was 75% and Density was 2.0.

EXAMPLE 19

Example 23 below was repeated using 0.6 gram RV 6300, 3.1 grams RV 6803 (both magenta pigments) and 4.8 grams Cab-O-Sil EH-5 in place of Mogul L (carbon black). Resolution was 6.3, Transfer Efficiency was 84% and Density was 1.7.

EXAMPLE 20

Example 8 was repeated using 35 grams of YT-858D Dalamar yellow and 95 grams Cab-O-Sil EH-5 in place of Mogul L (carbon black). Resolution was 4.5, Transfer Efficiency was 40% and Density was 0.9. Poor image quality resulted from excessive, highly tentacular and excessive adhesive.

EXAMPLE 21

A toner image on a conducting substrate was prepared. This could be done, for example, using toner from Example 1 in a Savin 870 copier with aluminized Mylar® as the substrate or by transferring a toner image from an intermediate to a copper board. The exposed metal was etched using an acid etching solution (161 grams cupric chloride dihydrate, 568 mL concentrated hydrochloric acid and 350 mL water). The toner was then dissolved (hot 1:1 toluene:n-butanol) to give a conductive pattern of the same image quality as the original toned image.

EXAMPLE 22

The Ross mixer was charged with 500 g of Isopar® L and 500 g of Elvax II grade 5720. The mixture was stirred and heated at 85°-90° until the resin was melted. Then 66.7 g of Dalamar Yellow YT-858D and 100 g of Cab-O-Sil M-5 were added. Mixing was continued at the same temperature until the pigments were dispersed. Then 1500 g of additional Isopar® L was added at such a rate as to maintain the temperature at 85°-90° C. When all of the Isopar® was added, the liquid gel was poured out into cake pans and allowed to cool to room temperature. A portion of this gel was ground in a Waring Blender. 100 g of the ground gel and 100 g of Isopar® H were placed in a ceramic mill jar containing 750 g of ½" by ½" Burundum cylinders. The mill jar was placed on a 250 rpm roller and was rolled for 186 h. The resulting concentrate was removed from the mill jar and was diluted with further Isopar® H and charge director as in Example 1 to give a yellow toner. Resolution was 6.3, Transfer Efficiency was 63% and Density was 1.4–1.5.

EXAMPLE 23

This procedure allows for the preparation of liquid toner in a single piece of equipment and without handling the material between steps. 25 g Elvax II resin 5720 and 125 g Isopar® L are heated to 90° C. in an 01 air attritor and milled 3/16 inch stainless steel balls; when the resin and solvent mixture is homogeneous 8.0 g carbon black (Mogul L) is added and milled until dispersed. Alternately, the pigment may be added simultaneously with the resin and Isopar® L and milled at 90° C. until the pigment is dispersed. The attritor is cooled to room temperature while milling is continued and then 130 g Isopar® H is added. Milling is continued at room temperature until the desired particle size is achieved (1–2 microns). The dispersion is then diluted with Isopar® H and charge-directed. Toner prepared by this procedure is equivalent to that of Example 9.

Using this procedure, 200 grams of Elvax II resin 5720, 67 grams Mogul L, 1000 grams Isopar® L, and 700 grams Isopar® H are milled in a 1-S attritor to produce toner which also is equivalent to that of Example 9.

Figure 2:
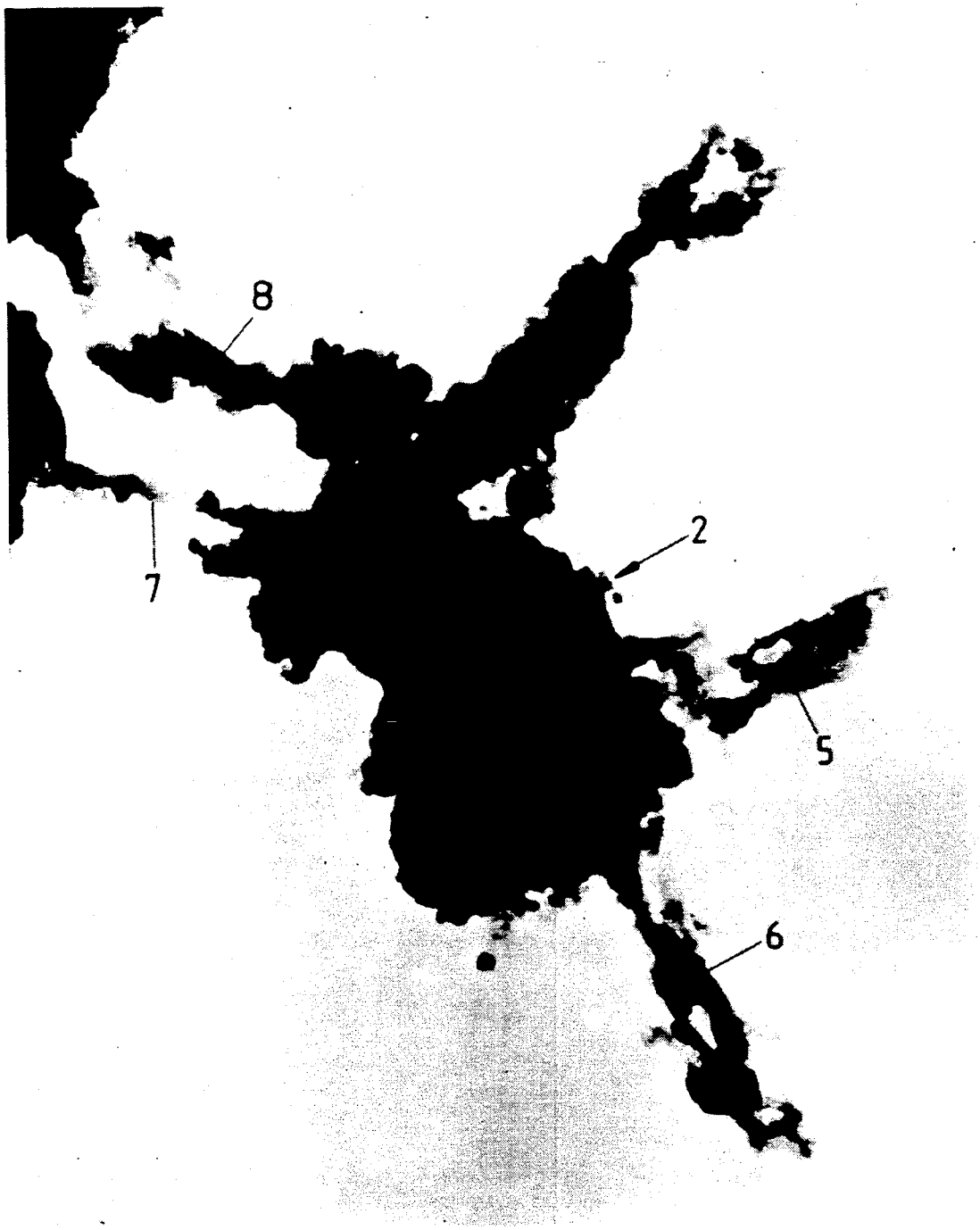
FIG. 2 is a photomicrograph taken with a transmission electron beam microscope of a toner particle shown in FIG. 1, at a magnification of 45,000 times.
Figure 3:
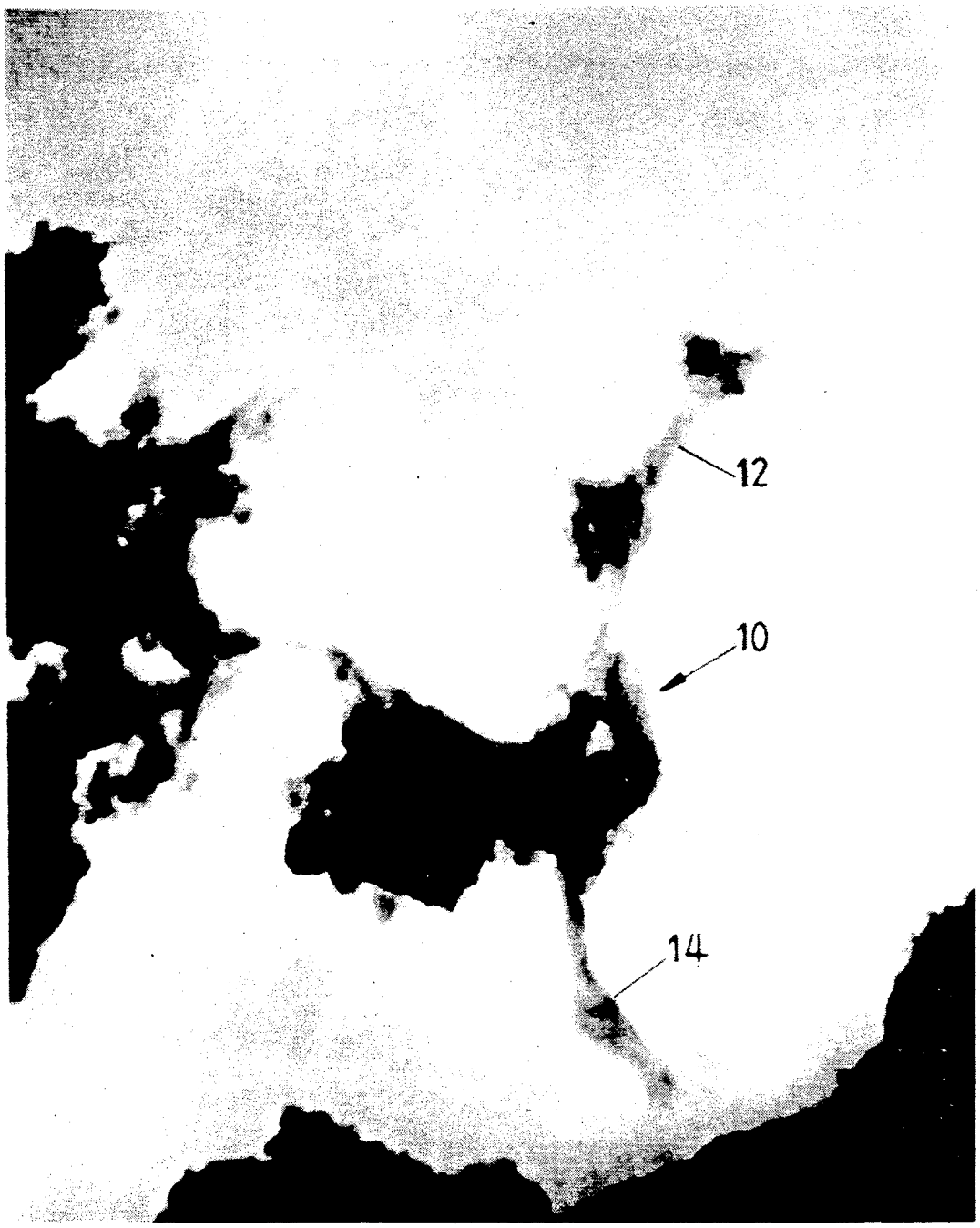
FIG. 3 is a photomicrograph taken with a transmission electron beam microscope of another toner particle of our invention shown in FIG. 1, at a magnification of 45,000 times.
Figure 4:
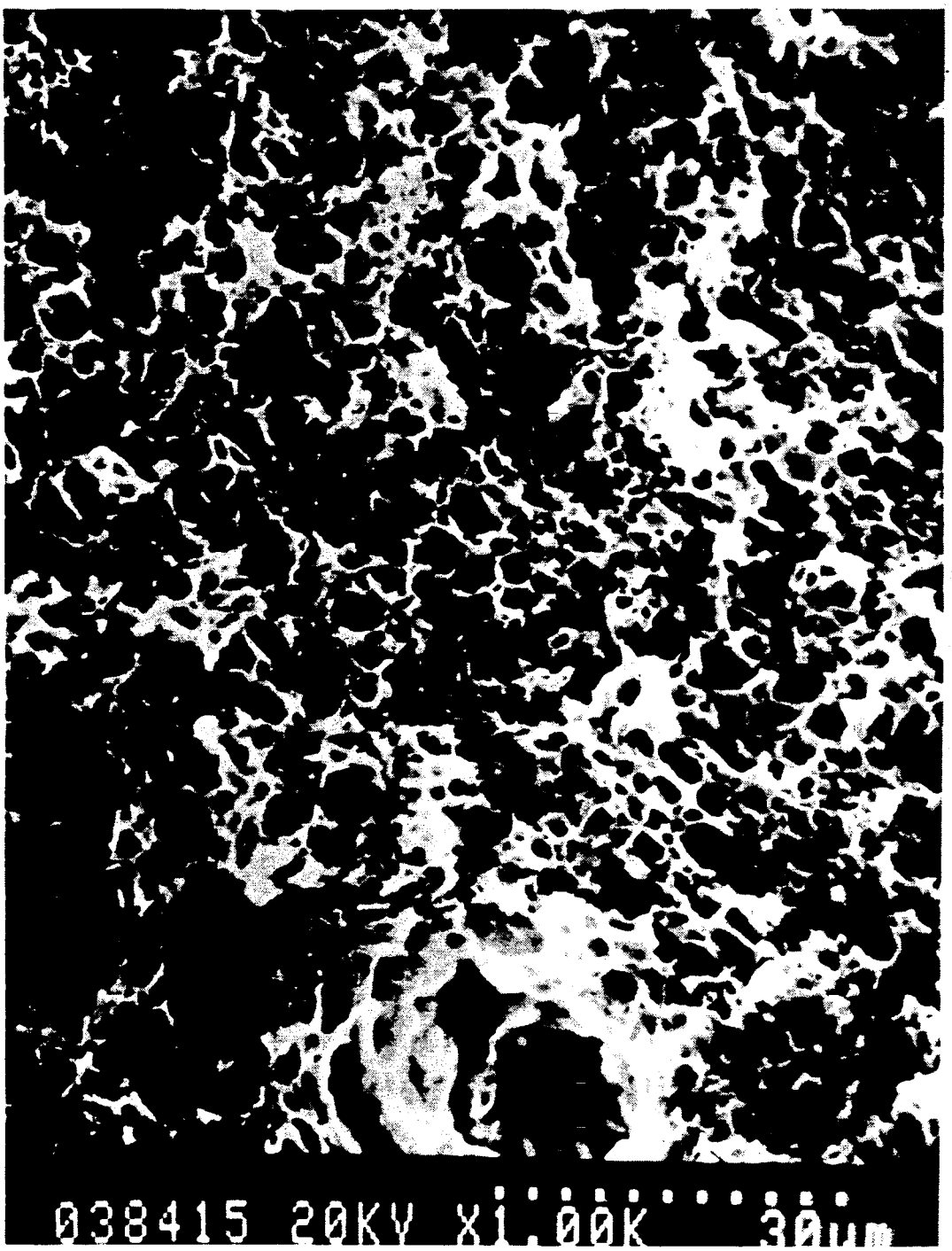
FIG. 4 is a photomicrograph taken with a scanning electron beam microscope at a magnification of 1,000 times, showing a sponge achieved during an intermediate step of one method of manufacturing our improved toner particle.

Referring now to the drawings, the toner particles shown in FIGS. 1, 2, and 3 and the sponge shown in FIG. 4 are all formed with ELVAX II Grade 5720 resin. These photomicrographs were taken by the transmission method. In it, a copper grid was coated with a layer of collodion which had been evaporated at room temperature. A drop of developing liquid, diluted with 3 percent toner solids, was placed on the thus-prepared grid and allowed to evaporate. The specimen was then placed directly in the cavity of the electron beam microscope and examined.

In FIG. 1, the toner particle 2 shows tendrils or fibers 4, 5, and 6. The tendrils 7 and 8 have become associated with a clump of toner particles. Toner particle 10, which happens to be detached, is formed with fibers 12 and 14. The magnification was 13,000 times.

FIG. 2 is a photomicrograph of toner particle 2 of FIG. 1, magnified 45,000 times. It will be seen that fiber 8 is attached to the clump of toner particles 2, while fiber 7 extends from an adjacent toner particle.

FIG. 3 is a photomicrograph of toner particle 10, shown in FIG. 1, magnified 45,000 times. It will be seen that fibrils extend from toner particle 10 to an adjacent clump of toner particles.

It should be noted that it is difficult to obtain good pictures of the toner morphology, since the electron beam tends to melt the fibers and disguise their morphology to some extent.

FIG. 4 shows a sponge which, as has been described, is formed from a plasticized polymer. The magnification in this photomicrograph is 1,000 diameters, and the eleven dots shown at the bottom of the photomicrograph extend through 30 microns.

Figure 5:
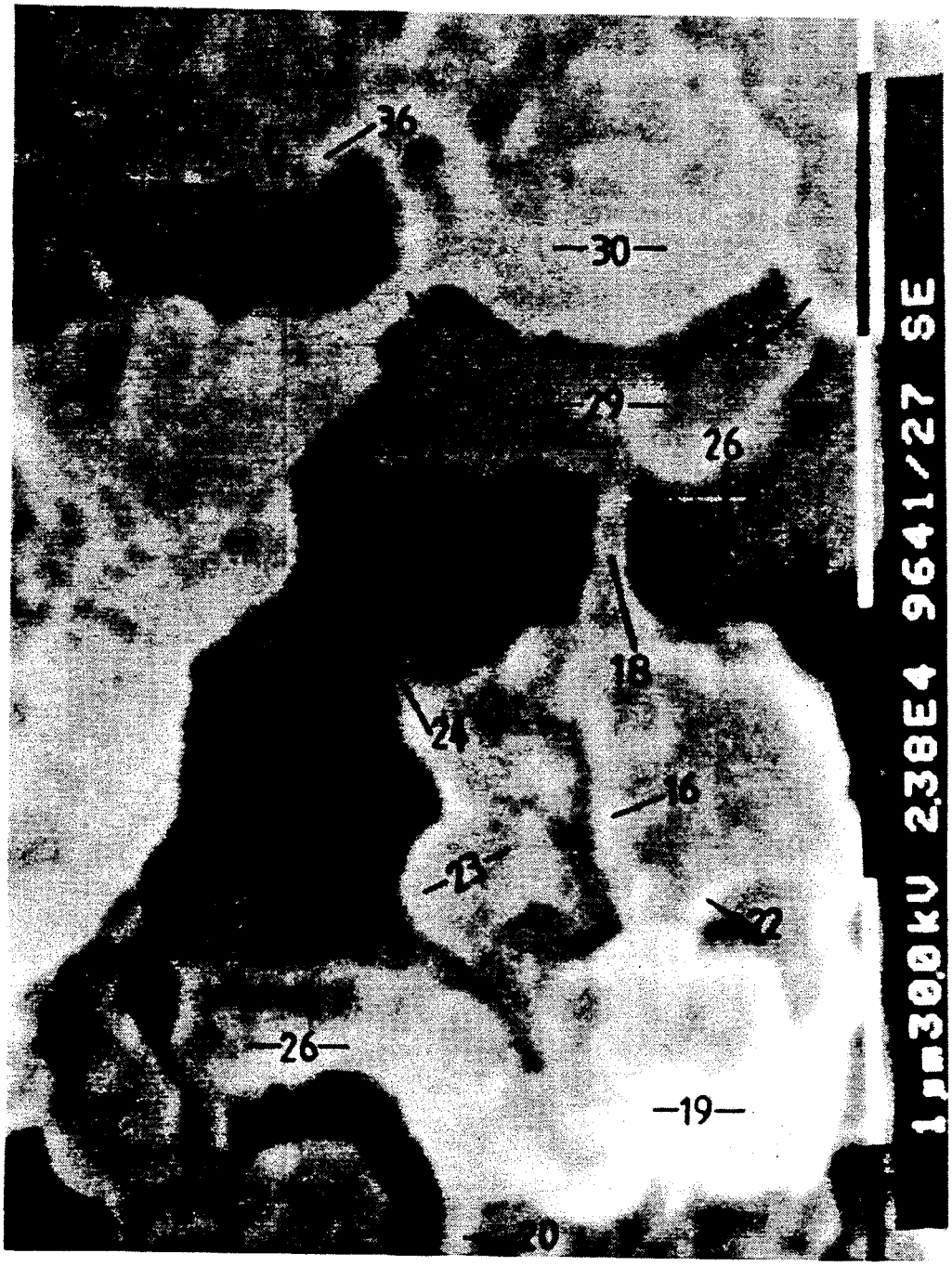
FIG. 5 is a photomicrograph taken with a scanning electron beam microscope at a magnification of 23,800 times, showing a plurality of toner particles of our invention.
Figure 6:
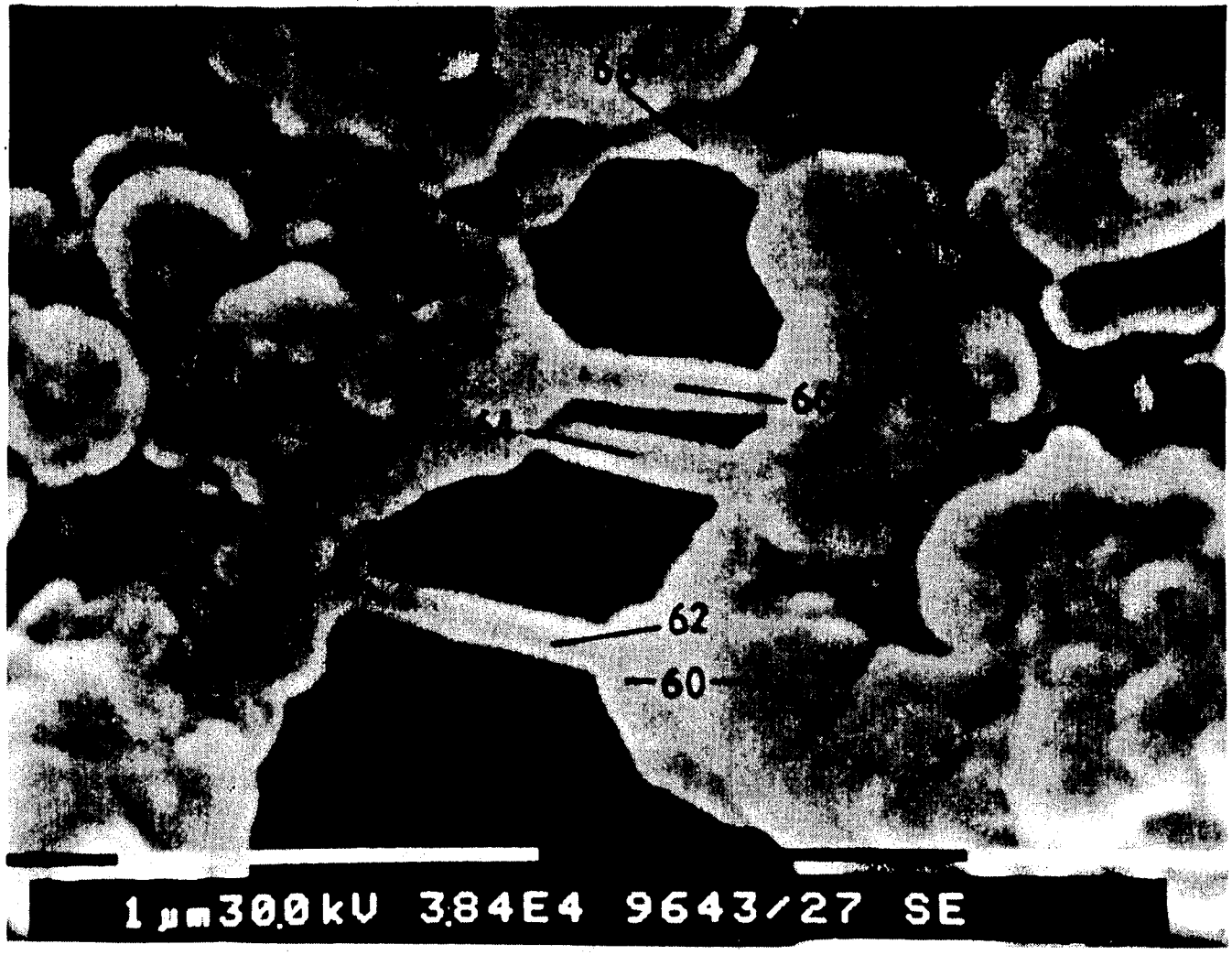
FIG. 6 is a photomicrograph taken with a scanning electron beam microscope at a magnification of 38,400 times, showing a plurality of toner particles of our invention.
Figure 7:
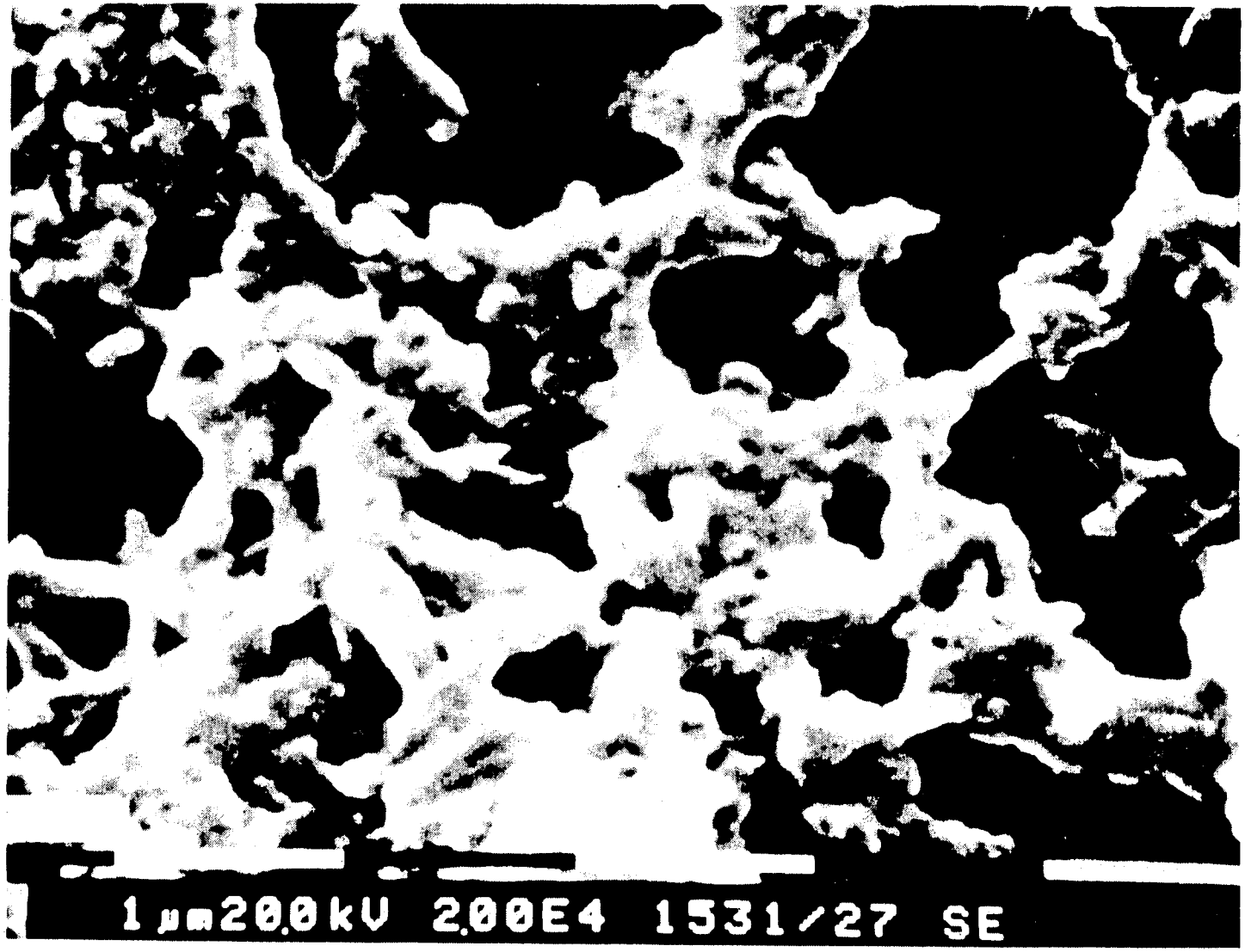
FIG. 7 is a photomicrograph taken with a scanning electron beam microscope at a magnification of 20,000 times, showing a plurality of toner particles of our invention made by another method of manufacturing the toner particles of our invention.

FIGS. 5, 6, and 7 are photomicrographs taken with the scanning method. In carrying out this method, a drop of developing liquid having a toner content of 2 percent is allowed to evaporate on a glass slide. After the carrier liquid has evaporated at room temperature, the slide is fractured and a piece or pieces are mounted with a conductive adhesive on an aluminum stub or stubs. The stubs are then coated with a layer of gold, 100 Å in thickness, by vacuum deposition, and the specimen is then placed in the cavity of the electron beam microscope.

The specimen shown in FIG. 5 is one taken with the developing liquid shown in Example 15. The magnification was 23,800 diameters. Several levels of toner particles are clearly visible in this photomicrograph. The toner particle 30 has fibrils 32, 34, and 36 extending therefrom. Toner particle 29 has a fibril 18 extending therefrom. Fibers 24 and 26 extend from a toner particle which appears at a lower level. Toner particle 19 has fibrils 16 and 22 extending therefrom. Toner particle 23 has a fibril extending therefrom. Toner particle 26 has a fibril 20 extending therefrom. It will be appreciated that, in taking the photomicrograph, many of the fibers, vestiges of which appear, have been melted by the electron beam.

FIG. 6 is another photomicrograph taken with the scanning method and having the formulation of Example 15. The magnification was 38,400 diameters. The alternate black and white lines at the right-hand side of the drawing indicate one micron. The fibers at various levels are clearly shown in this drawing. From toner particle 60, fibers 62, 64, and 66 are shown. Fiber 68 is also shown, extending from an unidentified toner particle. Other fibers are shown at lower levels.

FIG. 7 shows a plurality of toner particles made in accordance with the method of Example 8, which is the preferred method. The resin was ELVAX II Grade 5720, the preferred polymer. The magnification was 20,000 diameters. The toner particles having a plurality of fibers, many interdigitated, are clearly shown in this view.

While we are not bound by theories, it would appear that, in dispersion, all of the toner particles have the same polarity of charge. When the particles approach each other, they are repelled, owing to the fact that each possesses a charge of the same polarity. When the latent electrostatic image is developed, the toner particles are impelled to go to the latent electrostatic image, which has a higher potential and a charge of opposite polarity. This forces the toner particles to associate with each other and to mat or interdigitate. The strength of the image is such that, if the paper has a rough surface, the image will bridge the hollows When the image is transferred to a carrier sheet, since the transferring charge is also greater than the charge of the developed image, interdigitation or matting is preserved. This gives a dense image. The fact that the toner particles in the developed image are matted enables a more complete transfer from the photoconductor to be made to the carrier sheet. The matting also prevents spreading of the edges of the image and thus preserves its acuity. The small diameter of the toner particles ensures good resolution, along with the other results outlined above.

It will be seen that we have accomplished the objects of our invention. We have provided a toner particle adapted to form a denser electrostatic image than has been achieved by the prior art. The toner particles of our invention are adapted to form a mat, in developing a latent electrostatic image, and thus enable complete transfer of the developed image to a carrier sheet by contact transfer. An image formed with a liquid developing composition employing a dispersion of our toner particles may be transferred to a carrier sheet without any squash. Images developed with the toner particles of our invention exhibit no bleedthrough. Our toner particles may be used to form a concentrate, which concentrate may be diluted to a liquid composition having a toner solids content of as little as 0.2 percent. We have disclosed several novel methods of producing toner particles having fibers extending therefrom. Some include the step of plasticizing a polymer. In one method, the plasticized polymer is allowed to form sponge. In another method, a dispersant is continuously added and stirred so that no sponge is permitted to form.

It will be observed that it is a necessary feature of our invention that the toner particles be charged, and we have pointed out the addition of a charge director. Since these charge directors are known to the art, we have not particularly set them forth in this specification. It is known that, in order to impart a negative charge to the particles, such charge directors as magnesium petronate, magnesium sulfonate, calcium petronate, calcium sulfonate, barium petronate, barium sulfonate, or the like, may be used. The negatively charged particles are used to develop images carrying a positive charge, as is the case with a selenium-based photoconductor. With a cadmium-based photoconductor, the latent image carries a negative charge and the toner particles must therefore be positively charged. We may impart a positive charge to the toner particles with a charge director such as aluminum stearate. The amount of charge director added depends on the composition used and can be determined empirically by adding various amounts to samples of the developing liquid, as we have pointed out in Example 1.

It will be understood that certain features and subcombinations are of utility and may be employed without reference to other features and subcombinations. This is contemplated by and is within the scope of our claims. It is further obvious that various changes may be made in details within the scope of our claims without departing from the spirit of our invention. It is, therefore, to be understood that our invention is not to be limited to the specific details shown and described.

Having thus described our invention, what we claim is:

1. A method of producing toner particles adapted for electrophoretic movement through a nonpolar liquid comprising the steps of plasticizing at a temperature in the range of about 65° C. and 100° C. a thermoplastic polymer with a nonpolar liquid having an electrical volume resistivity in excess of about $10^9$ ohm centimeters and a dielectric constant below about 3.0 to form a sponge, shredding said sponge into pieces, adding more nonpolar liquid, wet-grinding the pieces into particles, and continuing the grinding step to pull the particles apart to form fibers extending therefrom.

2. A method of producing toner particles adapted for electrophoretic movement through a nonpolar liquid comprising the steps of plasticizing at a temperature in the range of about 65° C. and 100° C. an ethylene copolymer resin and a pigment with a nonpolar liquid having an electrical volume resistivity in excess of about $10^9$ ohm centimeters and to form a sponge, cooling said sponge, shredding the sponge into pieces, adding more nonpolar liquid, wet-grinding the pieces into particles, continuing the grinding step to pull the particles apart to form fibers extending therefrom, and adding a charge director to impart a charge of predetermined polarity to the toner particles.

3. The method according to claim 1 wherein a charge director is added to impart a charge of predetermined polarity to the toner particles.

4. The method according to claim 1 wherein the particles are less than about 5 microns.

5. The method according to claim 1 wherein the thermoplastic polymer is selected from the group consisting of ethyl vinyl acetate copolymers, isotactic polypropylene, polybutyl terethalate, ethylene ethyl acrylate, ethylene vinyl acetate, methacrylate resins.

6. The method according to claim 1 wherein the polymer is an ethylene copolymer having carboxylic acid functionality and an acid number between about 54 and 90.

7. The method according to claim 1 wherein the polymer is an ethylene copolymer resin.

8. The method according to claim 1 wherein the sponge has a hardness of at least 120.

9. The method according to claim 1 wherein the sponge has a hardness of between about 25 and 45.

10. The method according to claim 1 wherein the step of plasticizing ranges from between about ten minutes and 3 hours.

11. The method according to claim 2 wherein the thermoplastic polymer is selected from the group consisting of ethyl vinyl acetate copolymers, isotactic polypropylene, polybutyl terethalate, ethylene ethyl acrylate, ethylene vinyl acetate, methacrylate resins.

12. The method according to claim 2 wherein the ethylene copolymer has an acid number between about 54 and 90.

13. The method according to claim 2 wherein the sponge has a hardness of at least 120.

14. The method according to claim 2 wherein the sponge has a hardness of between about 25 and 45.

15. The method according to claim 2 wherein the step of plasticizing ranges from between about ten minutes and 3 hours.

16. The method according to claim 2 wherein the particles are less than about 5 microns.

17. The method according to claim 2 wherein the particles are less than about 10 microns.

18. A method of producing toner particles adapted for electrophoretic movement through a nonpolar liquid comprising the steps of plasticizing at a temperature in the range of about 65° C. and 100° C. an ethylene copolymer resin with a nonpolar liquid having an electrical volume resistivity in excess of about $10^9$ ohm centimeters and to form a sponge, shredding the sponge into pieces, wet-grinding the pieces into particles, pulling the particles apart to form fibers extending therefrom, and adding a charge director to impart a charge of predetermined polarity to the toner particles.

* * * * *

UNITED STATES PATENT AND TRADEMARK OFFICE
CERTIFICATE OF CORRECTION

PATENT NO. : 5,047,307

DATED : September 10, 1991

INVENTOR(S) : Benzion Landa, et. al.

It is certified that error appears in the above-identified patent and that said Letters Patent is hereby corrected as shown below:

On the Title page, after "[60]" delete entire paragraph and insert the following:
--Continuation of Ser. No. 287,840, Dec. 21, 1988, abandoned, which is a division of Ser. No. 157,122, Feb. 10, 1988, Pat. No. 4,794,651 (which is a continuation of Ser. No. 045,168, Apr. 24, 1987, abandoned, which is a continuation of Ser. No. 679,906, Dec. 10, 1984, abandoned) and a continuation- in - part of Ser. No. 242,242, Sept. 9, 1988, abandoned.--

Abstract col. 2, line 2 change "the" to --a--.
col. 2, line 30, change "solution" to --solution--.
col. 2, line 33, change "et seq" to --et seq--.
col. 2, line 36, change "et seq" to --et seq--.
col. 2, line 43, change "dissolve" to --dissolve--.
col. 2, line 61, change "et seq" to --et seq--.
col. 7, line 12 delete "Stringent" and insert --Due to stringent--.
col. 7, line 13, before "such" insert -- constituents--.
col. 17, line 10, after "milled" insert --with--.
col. 18, line 44, after "hollows" insert --.--.

Signed and Sealed this

Eleventh Day of May, 1993

*Attest:*

Michael K. Kirk

MICHAEL K. KIRK

*Attesting Officer*

*Acting Commissioner of Patents and Trademarks*